US012209376B2

(12) United States Patent
Burkett

(10) Patent No.: US 12,209,376 B2
(45) Date of Patent: Jan. 28, 2025

(54) ANIMAL GUARD FOR PROTECTING A BANK OF A BODY OF WATER

(71) Applicant: Darryl S. Burkett, Fox River Grove, IL (US)

(72) Inventor: Darryl S. Burkett, Fox River Grove, IL (US)

( * ) Notice: Subject to any disclaimer, the term of this patent is extended or adjusted under 35 U.S.C. 154(b) by 85 days.

(21) Appl. No.: 17/945,704

(22) Filed: Sep. 15, 2022

(65) Prior Publication Data

US 2024/0093449 A1 Mar. 21, 2024

(51) Int. Cl.

| | |
|---|---|
| ***E02B 3/04*** | (2006.01) |
| ***E02D 7/06*** | (2006.01) |
| ***E02D 29/02*** | (2006.01) |
| ***E04H 17/16*** | (2006.01) |

(52) U.S. Cl.

CPC ..... *E02B 3/04* (2013.01); *E02D 7/06* (2013.01); *E02D 29/0266* (2013.01); *E02D 2300/0034* (2013.01)

(58) Field of Classification Search

CPC .. E04H 17/16; E02B 3/04; E02B 3/06; A01M 29/30

See application file for complete search history.

(56) References Cited

U.S. PATENT DOCUMENTS 1,095,249 A * 5/1914 Waddill ..... E02B 7/06 405/109
5,192,054 A * 3/1993 Sharp ..... E06B 11/04 256/22
6,631,887 B1 * 10/2003 Walmsley ..... E04H 17/1439 256/65.01
6,796,747 B1 * 9/2004 Vreeland ..... E02D 17/202 173/90
8,082,702 B2 * 12/2011 Hill ..... E02D 5/80 52/165
8,104,744 B2 * 1/2012 Brownbill ..... E04H 17/1439 256/22
11,555,327 B1 * 1/2023 Ou ..... E04H 17/08
2005/0184281 A1 * 8/2005 Bryan ..... E04H 17/166 256/25

(Continued)

OTHER PUBLICATIONS

FenceTrader; "How to install chain link fence with an electric jack hammer"; "https://www.youtube.com/watch?v=jhulVgt9-MQ"; full video; Jan. 2009 (Year: 2009).*

*Primary Examiner* — Benjamin F Fiorello
(74) *Attorney, Agent, or Firm* — Erickson Law Group, PC.

(57) ABSTRACT

The embodiments and methods of the invention provide for an effective protection of a bank of a body of water that reduces or eliminates the erosion effect of animal-burrowing below the mudline and behind the bank. An exemplary embodiment includes a guard that includes a top cross member and a plurality of spaced apart rods welded or otherwise attached to the top cross member. An intermediate cross member can also be welded or otherwise attached to the rods between the top member and a bottom end of the rods. The rods are spaced apart to have a specific clearance that prevents adult animals, such as muskrats from passing through the guard. Particularly, the spacing is such that the shoulder width of muskrats is too large to fit through adjacent rods. Plural guards can be driven into the bank side-by-side along the body of water to create a wall of guards.

9 Claims, 5 Drawing Sheets

(56) References Cited

U.S. PATENT DOCUMENTS

| | | | | |
|---|---|---|---|---|
| 2013/0105754 | A1* | 5/2013 | Filippo | E04H 17/16 256/59 |
| 2015/0021532 | A1* | 1/2015 | Smith | E04H 17/05 256/65.01 |
| 2019/0234042 | A1* | 8/2019 | Burkett | E02B 3/124 |
| 2019/0297790 | A1* | 10/2019 | Hsia | A01M 29/30 |
| 2023/0329225 | A1* | 10/2023 | Portuallo | A01M 29/30 |

* cited by examiner

ANIMAL GUARD FOR PROTECTING A BANK OF A BODY OF WATER

BACKGROUND

Bodies of water such as creeks, rivers, ponds and lakes are locations that beautify parks, golf courses and natural settings. These bodies of water are typically defined by banks a few feet in height. These bodies of water attract burrowing animals such as muskrats. Muskrats dig below and behind the banks of these bodies of water to make dens and to multiply. These dens can be numerous and can weaken the bank and cause serious erosion and receding of the bank. In many cases, efforts to trap and reduce the muskrat population has been ineffective.

As shown in FIG. 6, a bank 102 is along a body of water 104. A muskrat will burrow under water above the mudline 114 beneath the bank 102 and through the earth 103 via a tunnel 118 to a widened den 120 beneath a top surface 121 of grade behind the bank 102. Additionally, one or more escape tunnels 124 are dug from the den to the surface 121. Because of the undermining caused by the removed earth beneath top surface 121, an earthen roof 130 becomes weakened and vulnerable to collapse if weight is applied to the surface 121.

The present inventor has recognized the desirability of providing an effective method to protect a bank of a body of water which prevents the erosion caused by burrowing animals. The present inventor has recognized the desirability of providing articles that can be cost effectively manufactured and transported to the jobsite, the articles useful in protecting a bank of a body of water.

SUMMARY

The embodiments and methods of the invention provide for an effective protection of a bank of a body of water that reduces or eliminates the erosion effect of animal-burrowing beneath and behind the bank. An exemplary embodiment includes a guard that includes a top cross member and a plurality of spaced apart rods welded or otherwise attached to the top cross member. An intermediate cross member can also be welded or otherwise attached to the rods between the top member and a bottom end of the rods. The rods are spaced apart to have a specific clearance that prevents adult animals, such as muskrats from passing through the guard. Particularly the spacing is such that the shoulder width of the muskrats is too large to fit through adjacent rods. A plurality of guards can be installed into a bank side-by-side to form a wall of guards along the body of water.

The guard is driven in front of a receding bank such that the rods reach a depth of between 7-16 inches below the "mudline", the upper surface of the mud beneath the body of water. Animals, such as muskrats, are prevented from burrowing under and behind the bank by the presence of the guard. The guard is then back-filled behind and in front of the guard to create a repaired bank in front of the receded bank.

Plural guards can be connected together side-by-side by welding or other manner to form a wall of guards within the bank.

Numerous other advantages and features of the present invention will become readily apparent from the following detailed description of the invention and the embodiments thereof, from the claims and from the accompanying drawings.

DETAILED DESCRIPTION

Figure 1:
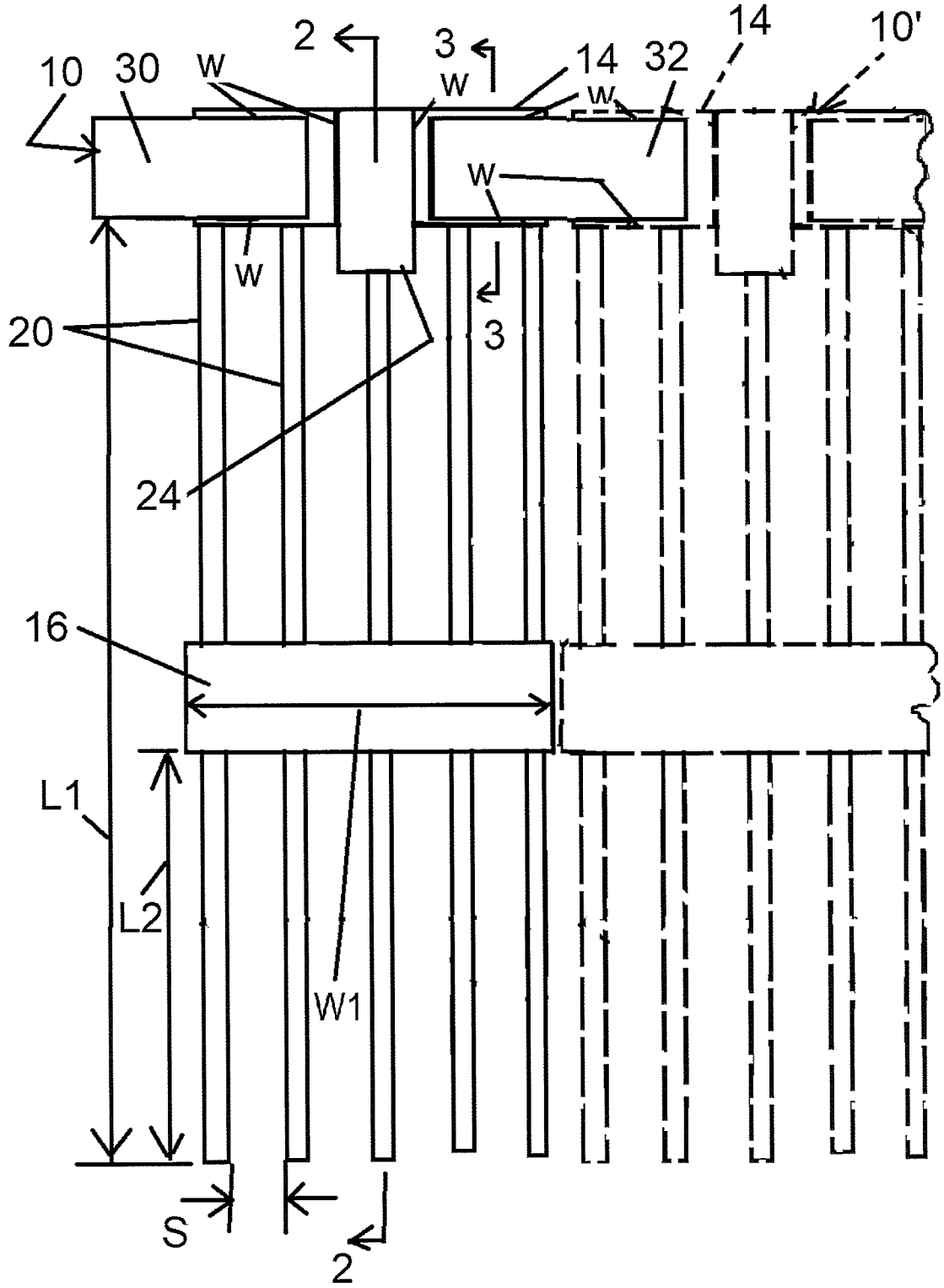
FIG. 1 is an elevational view of an embodiment of an animal guard according to the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
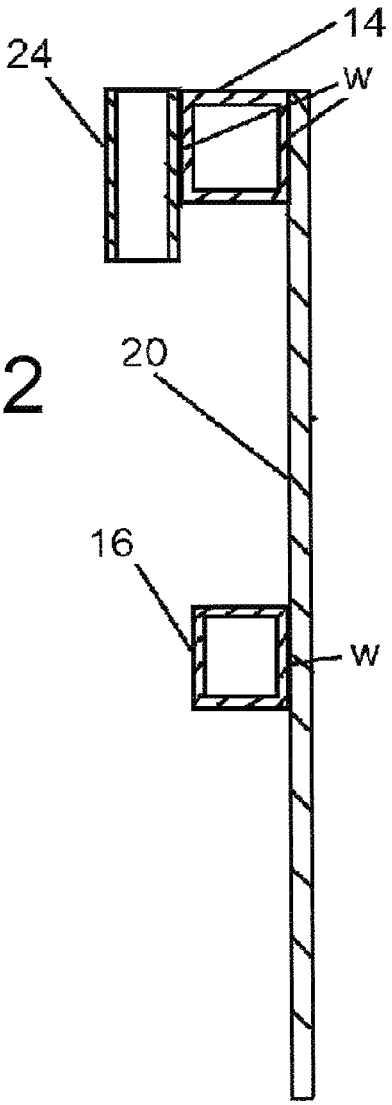
FIG. 2 is a sectional view taken through plane 2-2 of FIG. 1.
Figure 3:
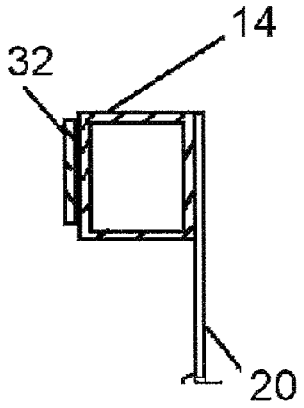
FIG. 3 is a fragmentary sectional view taken through plane 3-3 of FIG. 1.

FIGS. 1-3 illustrate an animal guard 10 according to one embodiment of the invention. The guards 10, 10' (described below) can be composed of steel or other metal or other appropriate material. The guard 10 includes an upper crossmember 14 and an intermediate cross member 16. The cross members 14, 16 are shown as square tubes. Alternately the crossmembers 14, 16 can be flat bar stock or other shape. The crossmembers 14, 16 can have a square cross section with outer dimensions 2 inch by 2 inch, and a thickness of about 3/16 inch.

A plurality of rods 20 (5 illustrated), such as ¾ inch diameter steel rebars, are welded (indicated by W) or otherwise attached to the cross members 14, 16. Although round cross-sectional rebar is described for the rods 20, other cross-sectional shapes are encompassed by the invention including flat bar stock or other shape. The rods 20 are arranged in parallel and spaced to have a clearance between rods of less than 3 inches, such as within a range between 3 inches and 2.25 inches. The rods can preferably be spaced to have a clearance between rods of about 2.5 inches or less. Once the guard is driven into the ground, this spacing is small enough to prevent underground burrowing animals, such as adult muskrats, from passing through the guard 10.

A tool receptacle 24 comprising a vertical short square tube, is welded or otherwise attached to the upper cross member 14 at a center position of the cross member 14. This tool receptacle 24 allows a jack hammer, vibratory tool or similar powered tool to drive the guard into the ground. The tool can be a man-carried tool or one carried and operated by a construction vehicle, such as a backhoe. On each end of the upper cross member 14 are wing plates 30, 32 which can have dimensions 6 inch by 1.5 inch and a thickness of 3/16 inch and which extend 3 inches horizontally out from the last rod 20. The wing plates 30, 32 are welded or otherwise attached to the upper cross member 14. The wing plates provide a convenient connector flange to attach side by side guards by welding or otherwise attaching the upper crossmembers 14 of adjacent guards by use of the wing plates 30, 32 as connectors.

An exemplary embodiment guard 10 can have an effective length L1 from the upper crossmember to an end of the rods 20 of about 36 inches. The guard 10 can have an effective length L2 from the lower crossmember 16, which acts as a mudline footing, to an end of the rods 20 of about 7-16 inches. The exemplary embodiment can have a width W1 of about 15 inches to 36 inches, depending on the number of rods 20.

FIG. 1 illustrates a first guard 10 connected to a further guard 10' (shown dashed) that is closely spaced, side-by-side with the first guard 10. The further guard 10' is identical to the first guard 10 except the left-wing plate 30 of the further guard 10' can be left off. After the first guard 10 is driven into the ground, the further guard 10' can be driven into the ground adjacent the first guard 10. The upper crossmembers 14 of the guards 10, 10' can be connected by the wing plate 32 of the first guard 10 being welded or otherwise connected to the further guard 10'. Although the further guard 10' is shown on a right side of the guard 10, another further guard 10' can be on the left side as well and additional further guards 10' can be added on both the right and left sides to create a wall of guards 10, 10' along the body of water.

Figure 1A:
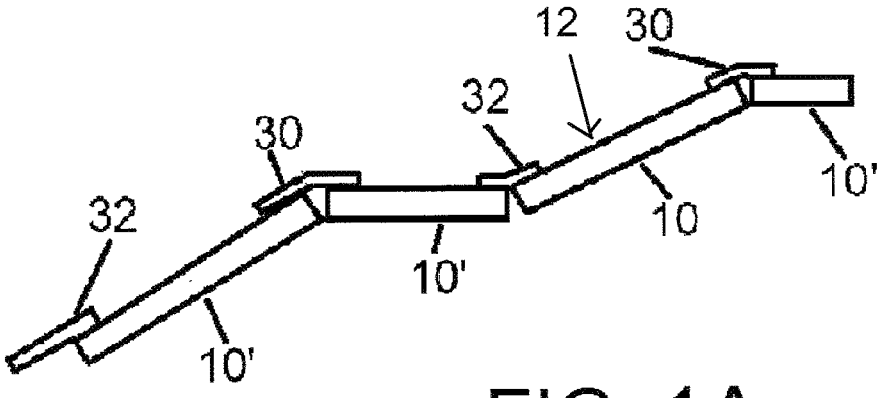
FIG. 1A is a plan view of guards forming a curved wall.

As shown in FIG. 1A, guards 10, 10' of larger and smaller widths can be used to allow a wall 12 of guards to follow a desired bank curvature. The wing plates 30, 32 can be bent to accommodate the curvature before welding or otherwise attaching adjacent guards 10 10' together.

Figure 4:
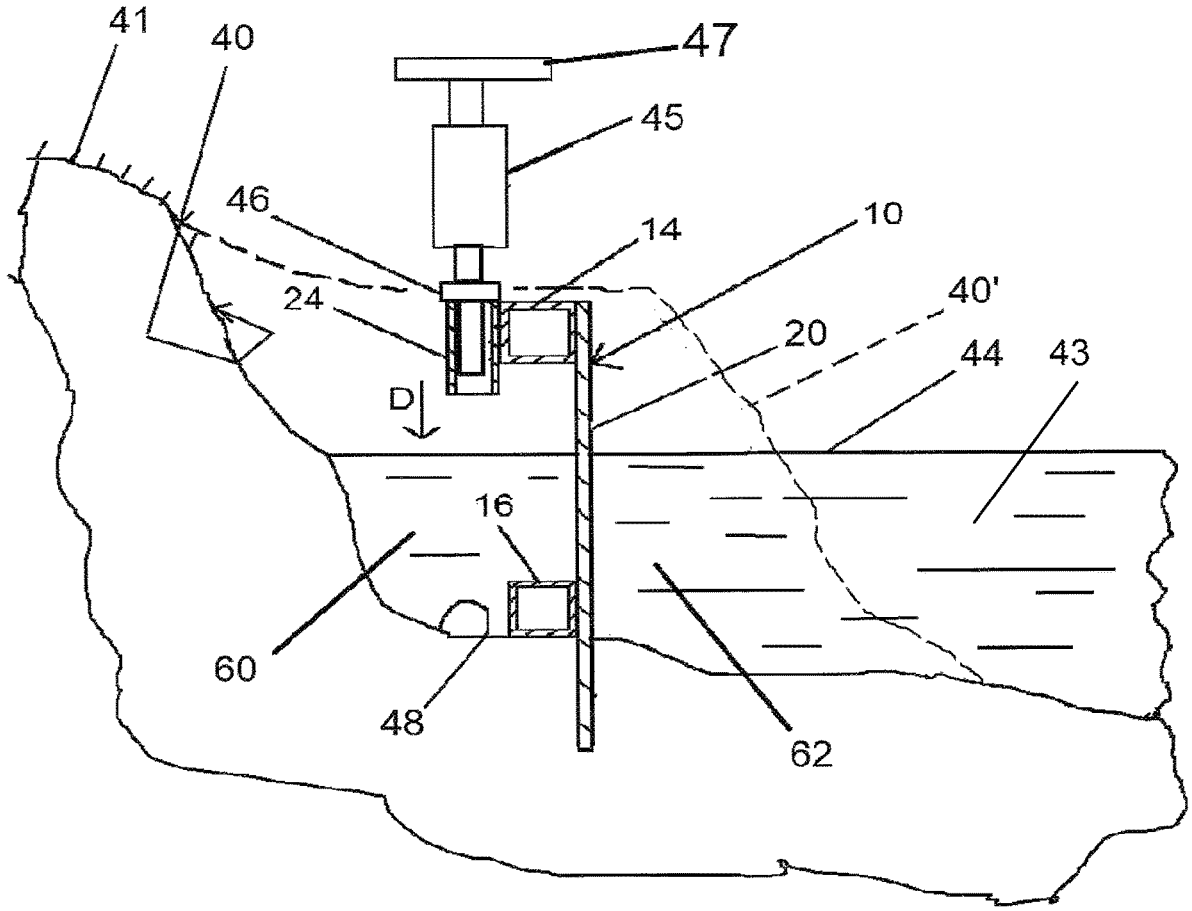
FIG. 4 is a sectional view of the animal guard of FIG. 1 shown being driven adjacent a bank of a body of water.

FIG. 4 shows the first guard 10 driven through the body of water 43 adjacent to a receded bank 40 having a grass area 41 on top. The body of water has a level 44. The first guard 10 is driven down into the mudline 48 beneath the body of water by a jack hammer or vibratory tool 45. The jack hammer or vibratory tool 45 has a tool engagement portion 46 that engages with, and presses down on, the receptacle 24. The jack hammer or vibratory tool can include a handle 47 for manual operation or can be operated off a vehicle or machine. The guard 10 is driven down to a depth where the intermediate crossmember 16 rests on a mudline 48 and acts as a footing for the guard. After the guard 10 is driven to this depth into the mudline 48, additional guards 10' are driven in the same fashion side-by-side on opposite sides of the guard 10 and welded to the guard 10 at the upper crossmembers 14 using the wing plates 30, 32. The plural guards 10, 10' form the wall 12. The front and back areas 60, 62 are backfilled as described in FIG. 5. A profile of a repaired bank 40', in front of the receded bank 40, is shown dashed in FIG. 4.

FIG. 4 is a cross section with the understanding that each element extends into the page along the wall 12.

Figure 5:
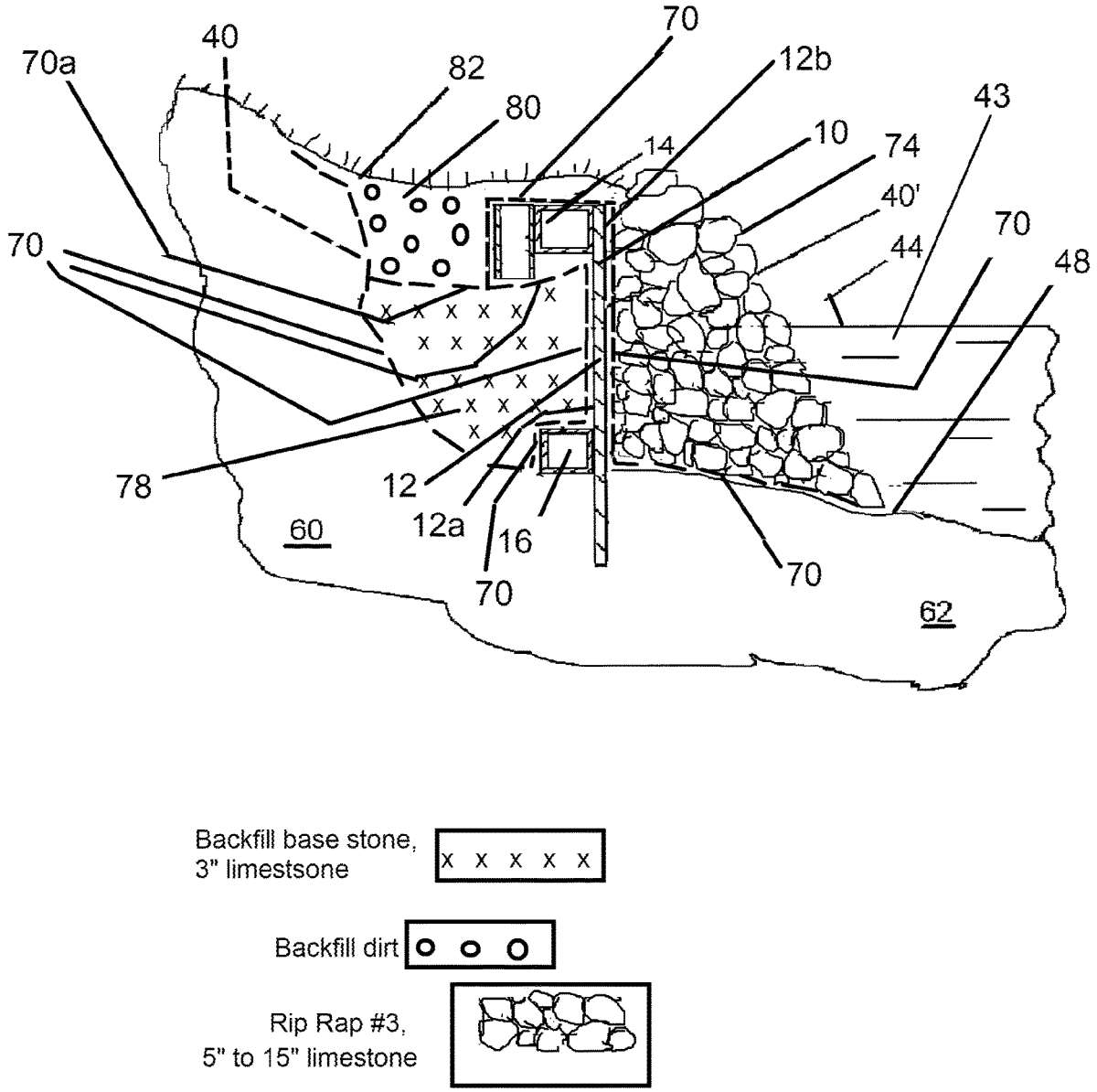
FIG. 5 is a sectional view of a further condition of the bank of FIG. 4, representing a repaired bank.
Figure 6:
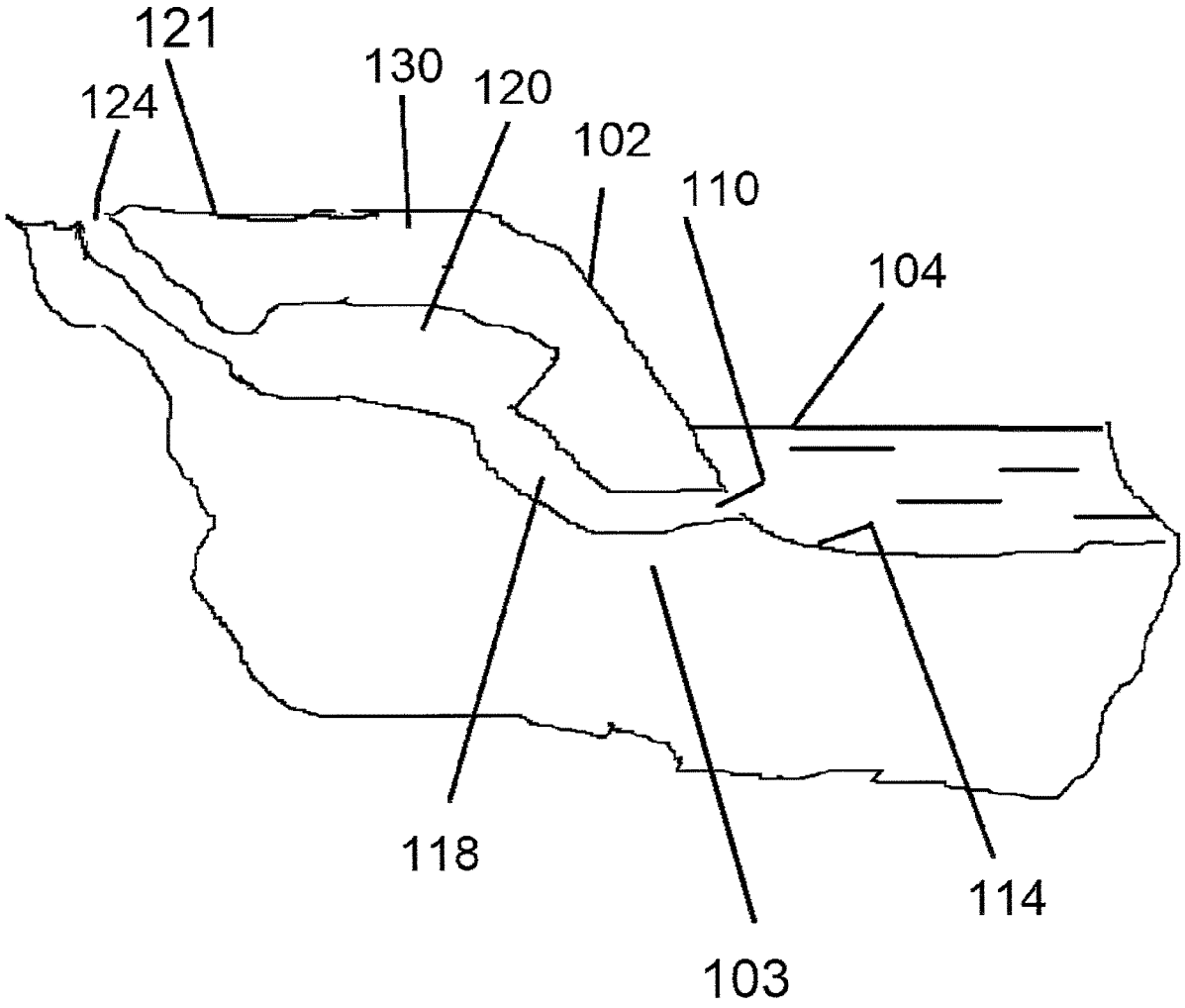
FIG. 6 PRIOR ART
FIG. 6 is a sectional view of a bank and body of water demonstrating the adverse effect of burrowing by a muskrat or other burrowing animal.

FIG. 5 illustrates a completed repaired bank 40'. First the guards 10, 10' are driven into the mudline 48 until the intermediate crossmembers 16 rest on the mudline. The wing plates 30, 32 are welded to adjacent guards 10, 10' forming the wall 12.

A nonwoven fabric 70 is placed against the receded bank 40, from a top position down along the receded bank and up and over the intermediate crossmembers 16 of the wall 12, and then up along a back side 12*a* of the wall 12, and then under the upper crossmembers 14 and tool receptacles 24 of the wall, and then up and across the upper crossmembers 14 and tool receptacles 24 of the wall to a front side 12*b* of the wall and then down the front side 12*b* of the wall, and then to the mudline 48 and extended away from the front side 12*b* wall along the mudline 48.

A pile 74 of rip rap #3 comprising 5" to 15" limestone is placed on the fabric 70 on the mudline and against the front side 12*b* of the wall. Back fill base stone 78 comprising 3" limestone is filled against the fabric 70 that is against the back side 12*a* of the wall, and on and against the fabric 70 that covers the receded bank 40. A flap 70*a* of non-woven fabric is placed over the back fill base stone 78. Back fill dirt or soil 80 is placed over the flap 70*a* of non-woven fabric and over the wall 12 up to the pile 74. The upper layer of soil 80 can be seeded for grass, or turf laid, for a grass line 82. The intersections of the fabric 70 and the flap 70*a* can be stapled or otherwise attached or can be lapped.

FIG. 5 is a cross section with the understanding that each element extends into the page along the wall 12.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. An animal guard for a receding bank, comprising:
- an upper horizontal crossmember formed as a first square tube;
- a vertically arranged tool receptacle tube for receiving the end of a powered driving tool, the receptacle tube connected to a side of the upper horizontal crossmember;
- a horizontal intermediate crossmember located below the upper crossmember formed as a second square tube;
- a plurality of vertical rods attached to sides of the upper crossmember and the intermediate crossmember, the rods having free end regions below the intermediate cross member arranged to be driven into the ground, the rods spaced apart with a clearance of less than 3 inches.

2. The animal guard according to claim 1, wherein the rods are spaced apart with a clearance of about 2.5 inches.

3. The animal guard according to claim 1, wherein the rods are spaced apart with a clearance of between 2.25 inches and 3 inches.

4. The animal guard according to claim 1, wherein the rods are spaced apart with a clearance of less than 2.5 inches.

5. A method for preventing a burrowing animal from burrowing behind a receding bank adjacent a body of water, comprising the steps of:
- providing a guard comprising:
- an upper horizontal crossmember;
- a horizontal intermediate crossmember located below the upper crossmember;
- a plurality of vertical rods attached to the upper crossmember and to the intermediate crossmember; the rods having free end regions below the intermediate crossmember, the rods spaced apart with a clearance of less than 3 inches;
- and
- placing the guard vertically into water adjacent the receding bank, and
- driving the free end regions of the guard into the ground beneath the water until the horizontal intermediate crossmember rests on ground beneath the water; and
- depositing fill material against the receding bank until the guard is buried beneath the fill material, to prevent burrowing animals from passing across opposite sides of the guard.

6. The method according to claim 5 comprising the further step of driving multiple guards into the ground in side-by-side fashion to create a wall.

7. The method according to claim 6 comprising the further step of driving the multiple guards into the ground using a jack hammer.

8. The method according to claim 5 wherein the rods have a spacing providing a clearance between rods that is less than 2.5 inches.

9. The method according to claim 5 wherein guards of different widths can be connected together to follow a curved bank.

* * * * *